United States Patent [19]

Brunn et al.

[11] 4,309,613

[45] Jan. 5, 1982

[54] X-RAY DIAGNOSTIC DEVICE FOR FLUOROSCOPIC EXAMINATION AND FILM EXPOSURE

[75] Inventors: Klaus Brunn; Eike Matura, both of Erlangen; Walter Polster, Spardorf; Herbert Schmitmann, Weiher, all of Fed. Rep. of Germany

[73] Assignee: Siemens Aktiengesellschaft, Berlin & Munich, Fed. Rep. of Germany

[21] Appl. No.: 94,767

[22] Filed: Nov. 14, 1979

[30] Foreign Application Priority Data

Dec. 21, 1978 [DE] Fed. Rep. of Germany ..... 2855405

[51] Int. Cl.[3] ..... H05G 1/30

[52] U.S. Cl. ..... 250/409; 250/402

[58] Field of Search ..... 250/402, 409, 410, 408

[56] References Cited

U.S. PATENT DOCUMENTS

| | | | |
|---|---|---|---|
| 3,902,069 | 8/1975 | Skarke et al. | 250/402 |
| 3,991,314 | 11/1976 | Schmitmann et al. | 250/402 |
| 4,080,536 | 3/1978 | Brehm et al. | 250/402 |
| 4,117,335 | 9/1978 | Franke | 250/402 |
| 4,160,906 | 7/1979 | Daniels et al. | 250/402 |

*Primary Examiner*—Bruce C. Anderson

*Attorney, Agent, or Firm*—Hill, Van Santen, Steadman, Chiara & Simpson

[57] ABSTRACT

An exemplary embodiment comprises an image intensifier television chain, a device for dose output regulation during fluoroscopy, a function generator for determining the exposure voltage from the fluoroscopic voltage, and an automatic exposure control which keeps the integral of the light output from image intensifier per exposure constant. A manual selector is present by which the exposure voltage can be set, e.g. at any whole number value between 50 kV and 125 kV independently of the automatic circuit for setting this voltage. The automatic exposure control is designed in such manner that, given the manual setting of the exposure voltage, the function generator changes the x-ray tube current given constant exposure time for patient thicknesses that lie below a lower value and, for patient thicknesses above this lower value, changes the exposure time given constant x-ray tube current.

3 Claims, 2 Drawing Figures

X-RAY DIAGNOSTIC DEVICE FOR FLUOROSCOPIC EXAMINATION AND FILM EXPOSURE

BACKGROUND OF THE INVENTION

The invention relates to an x-ray diagnostic device for fluoroscopic examination and for the recording of x-ray images, having an image intensifier-television chain, a device for controlling the dose output during fluoroscopic examination, means for determining the exposure data from the fluoroscopic data, an automatic exposure control and a function generator in which the course of the exposure voltage is programmed as a function of the fluoroscopic voltage, to which a signal corresponding to the respective fluoroscopic voltage is supplied and which derives therefrom an output signal controlling the setting means for the exposure data, in which a plurality of programs are stored in the function generator and means are present by means of which one of the stored programs is respectively manually selectable.

In an x-ray diagnostic device of this type, the setting of the exposure voltage for each individual exposure or exposure series is, in principle, not required, since it ensues automatically as a function of the fluoroscopic voltage which is a measure for the transparency of the patient. Nonetheless, it is possible to influence the data determining the characteristic of an exposure, particularly the respective exposure voltage, e.g. by the manual selection of a maximum or minimum value, for achieving optimum exposure conditions.

SUMMARY OF THE INVENTION

In practice, despite the possibility of influencing the exposure voltage, there exists the desire to be able to set a fixed exposure voltage in specific cases. The object of the invention, accordingly, is to design an x-ray diagnostic device of the type initially cited in such manner that this is possible.

This object is inventively achieved in that a setting device for the free setting of the exposure voltage is present and in that the automatic exposure control is designed in such manner that, given the fixed setting of the exposure voltage, for patient thicknesses that lie below a lower value, it adjusts the x-ray tube current given constant exposure time; and for patient thicknesses above the lower value, it adjusts the exposure time given constant x-ray tube current. In the inventive x-ray diagnostic apparatus, the control of the light integral (i.e. the time integral of the light output from the image intensifier) per x-ray exposure ensues given small patient thicknesses, in which the exposure time has its smallest possible value, via the x-ray tube current, whereas, given greater patient thicknesses, the exposure time is changed given constant voltage and constant current, i.e., given constant x-ray tube output.

According to a further development of the invention, a motion picture camera can be present for serial image recording together with means for setting the pulse width of the x-ray pulse per individual image. In this case, the automatic exposure control can change the exposure voltage given constant x-ray tube output and constant pulse width upon attainment of an upper limit of patient thickness which is allocated to the load limit of the x-ray tube. In this case, the maximum possible x-ray tube output always ensues.

In the following, the invention is explained in greater detail on the basis of an exemplary embodiment illustrated by the accompanying sheets of drawings; and other objects, features and advantages will be apparent from this detailed disclosure and from the appended claims.

DETAILED DESCRIPTION

Figure 1:
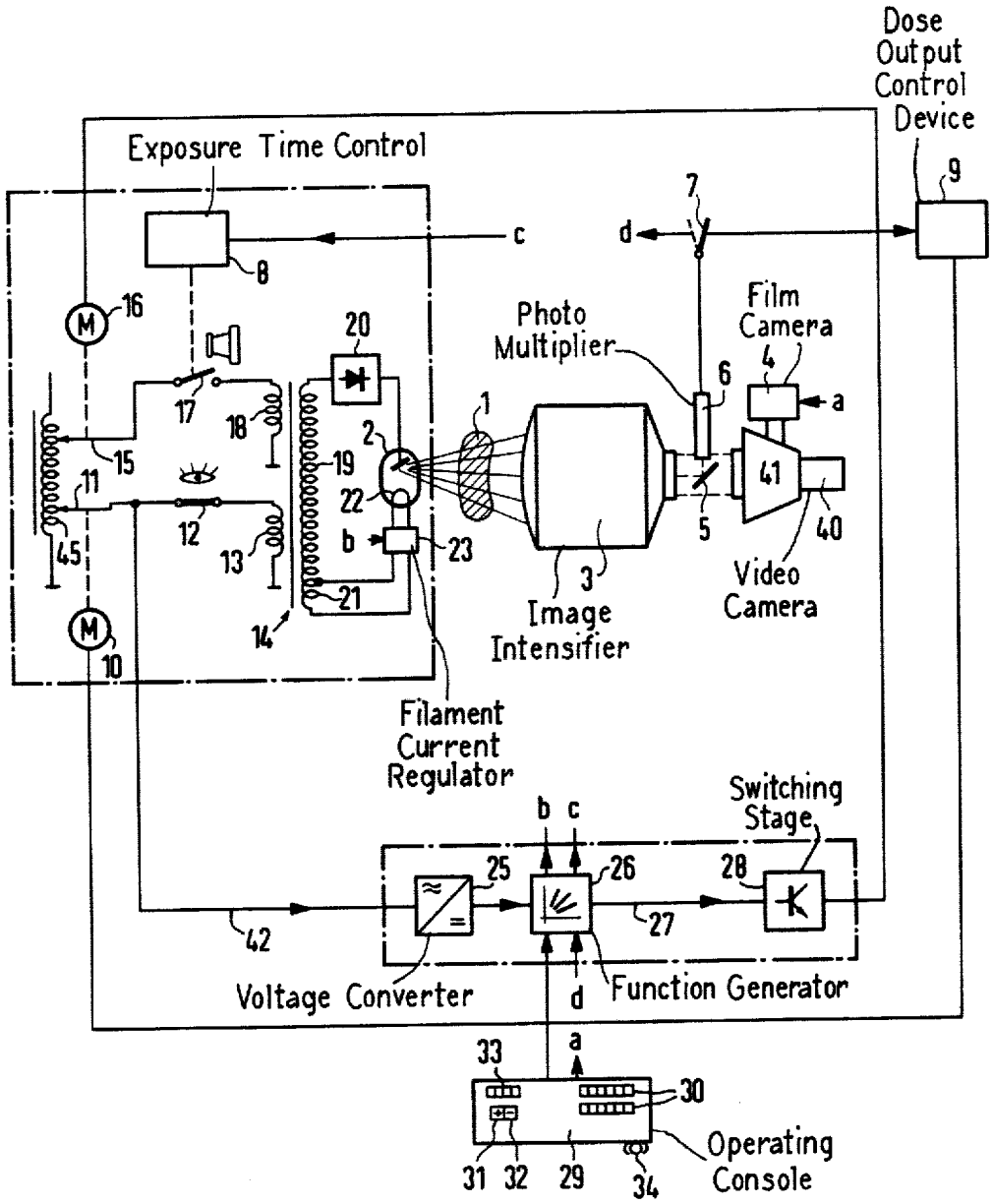
FIG. 1 shows a circuit diagram of an inventively designed x-ray diagnostic device.

A patient 1 who is positioned for examination by means of x-rays from an x-ray tube 2 is schematically illustrated in cross-section in FIG. 1. The images generated by the x-ray tube 2 are supplied by an image intensifier 3 to a television camera 40, and to a film camera 4 for recording of a series of exposures. The camera 4 may, for example, be a motion picture camera. A mirror 5 that supplies a signal corresponding to the brightness on the output screen of the image intensifier 3 to a photomultiplier 6 lies between the output screen of the image intensifier 3 and an optical separating device 41. The photomultiplier 6 can be selectively connected via a switch 7 to a function generator 26 (by means of a connection d) or to a dose output control device 9.

Given a fixed or variable (kV-dependent) fluoroscopic x-ray tube current, the dose output control device 9 controls a tap 11 of a regulating transformer 45 with its output signal via a regulating motor 10. The fluoroscopic voltage which is supplied via a switch 12, closed during fluoroscopy, to a primary winding 13 of a high voltage transformer 14 is determined by the tap 11. The adjustment of the exposure voltage at the x-ray tube 2 ensues by means of a tap 15 which can be adjusted by means of a regulating motor 16. The exposure voltage is supplied to a further primary winding 18 of the high voltage transformer 14 by means of a switch 17 closed during an exposure. The high voltage supply to the x-ray tube 2 ensues from a secondary winding 19 via a high voltage recitifier 20. A secondary winding 21 of the high voltage transformer 14 supplies the heating filament 22 of the x-ray tube 2. A regulator 23 for the heating current and, thus, the x-ray tube current, is connected to the function generator 26 via a control connection indicated at b. Moreover, the function generator 26 controls a time switch 8 for the determination of the exposure time of an x-ray exposure via a control connection indicated at c.

A signal corresponding to the respective fluoroscopic high voltage is supplied to a voltage converter 25 via a line 42. The voltage converter 25 controls the function generator 26 which generates an output signal at output 27 which depends on the input signal, i.e., on the fluoroscopic voltage, according to a preselected program and which corresponds to the exposure voltage allocated to the fluoroscopic voltage. The output signal of the function generator 26 on the line 27 controls a switching stage 28 which switches the regulating motor 16 on and off for setting the respective exposure voltage.

An operating console 29 which has keys 30 by means of which the respective image frequency of the camera 4 is selectable, is allocated to the x-ray diagnostic device illustrated in FIG. 1. The program for the respective exposure voltage in the function generator 26 is also selected via the selection of the image frequency.

During a fluoroscopic examination, the switches 7 and 12 assume the position indicated with solid lines. By means of the dose output control device 9, there ensues such an adjustment of the tap 11 and, thus, of the x-ray tube voltage and of the x-ray tube current that the brightness on the output screen of the image intensifier 3 is kept constant. As already mentioned above, the function generator 26 receives a signal corresponding to the respective fluoroscopic voltage from the voltage converter 25. The user selects that program in the function generator 26 by means of the keys 30, according to which the exposure voltage is to depend on the fluoroscopic voltage. Thereby, it is possible, for example, to store a function for each image frequency which represents the respective optimum exposure voltage for each patient thickness upon observation of the prevention of an overload of the x-ray tube 2. If, thus, the image frequency of the camera 4 is selected, then the optimum exposure voltage can be set via the signal at output 27, because the signal at the input of the function generator 26 that is supplied from the voltage converter 25 is a measure for the patient thickness.

If one is to switch from fluoroscopy to exposure, then switch 12 is opened and switch 17 is closed. The exposure voltage has already been set by the motor 16 during fluoroscopy to correspond to the respectively desired program, so that the correct voltage for the recording of an image series with the camera 4 already lies at the x-ray tube 2 upon closing the switch 17. Therefore, in the x-ray diagnostic device illustrated, one can change directly from fluoroscopy to exposure without it being necessary to specially adjust the exposure voltage.

At the beginning of an exposure, the switch 7 is also reset into the position indicated with broken lines, in which it supplies the function generator 26, which thereby forms an automatic exposure control, with a signal from the photomultiplier 6 corresponding to the dose output behind the patient 1. The function generator 26 effects that the integral of the light output from the image intensifier 3 per exposure remains constant. To this end, as a function of its input signal at d, the function generator 26 first influences the pulse width of the beam pulses generated per x-ray exposure via the switch 17 upon decreasing patient thickness, i.e., it influences via output c the time switch 8 in such manner that the pulse width decreases with decreasing patient thickness. When the lower limit of the exposure time per individual image, i.e., the lower limit of the pulse width, is achieved, then the function generator 26 changes the x-ray tube current via its output b to the regulator 23 in order to hold the light integral constant per exposure.

Two keys 31, 32 are provided at the operating console 29 upon whose actuation the automatic adjustment of the exposure voltage from the transillumination voltage is rendered ineffective. By actuating keys 31 and 32, thus, the exposure voltage can be freely set to a fixed value. Thereby, upon pressing key 31 the exposure voltage is increased and upon pressing key 32 it is reduced. The exposure voltage respectively set is displayed by a display device 33.

Figure 2:
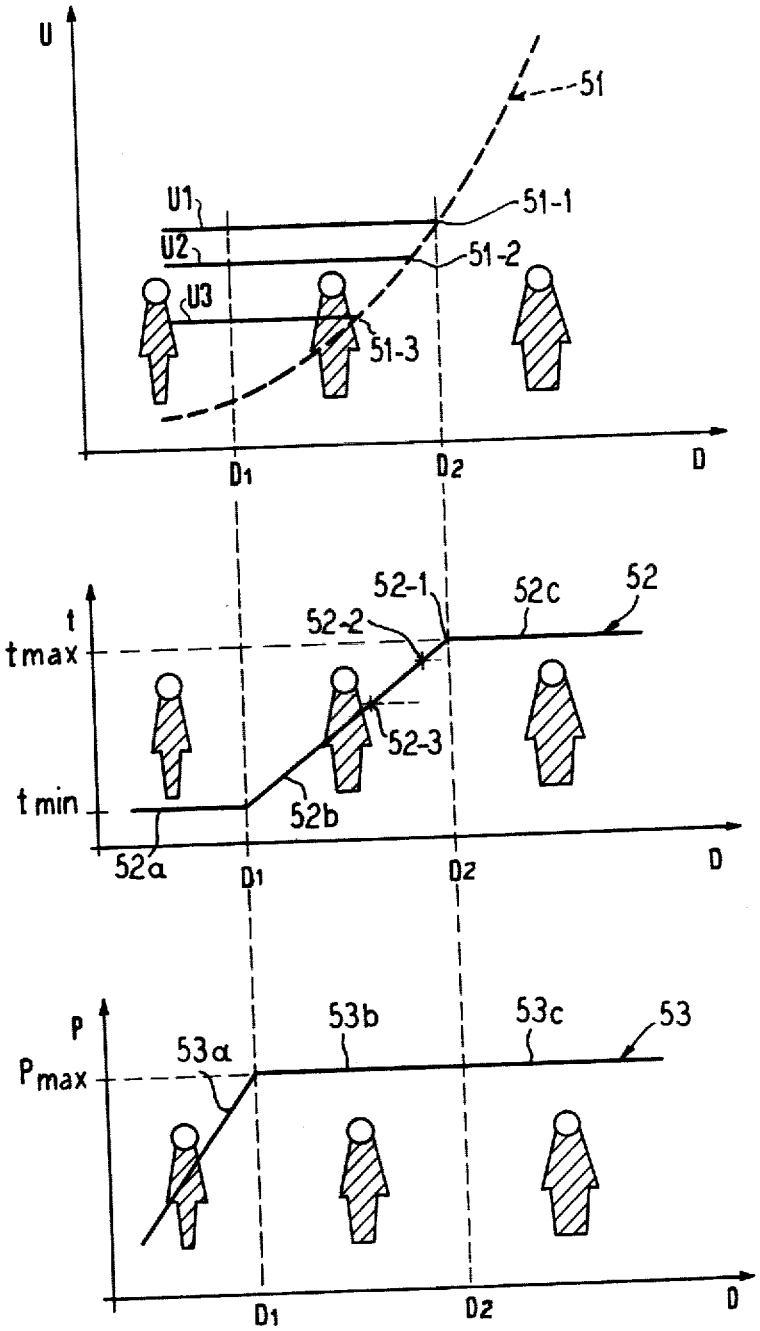
FIG. 2 shows a graphical illustration for explaining the operation of FIG. 1.

The relationships upon working with the setting of a fixed exposure voltage are explained in greater detail on the basis of FIG. 2. FIG. 2 shows by dash line 51 the minimum exposure voltage (U) as a function of patient thickness (D). Solid lines 52 and 53 show the adjustment to be made in exposure time t and x-ray tube output power p as a function of patient thickness D. If, given a specific patient thickness, a value of exposure voltage has been selected at 31–33 which is below the value represented by the dash line 51, then the x-ray tube would be overloaded because of the other exposure values automatically set. This means that the exposure voltage U must always have a value corresponding to that represented by the dash line 51, or a greater value. Three fixed values U1, U2 and U3 for the exposure voltage are illustrated in FIG. 2. Given the setting of a fixed exposure voltage via keys 31, 32 and display 33, the regulation of the light integral per exposure ensues via the x-ray tube current as indicated at 53*a* given constant minimum pulse width per exposure as indicated at 52*a* in that case in which the patient thickness D lies below a lower value D1. If this lower value of the patient thickness D1 is exdeeded, then, given constant x-ray tube current and, thus, constant x-ray tube output as indicated at 53*b*, the pulse width represented by ordinate t in relation to line 52 is adjusted as a function of patient thickness as indicated by sloping portion 52*b* of the line 52. As indicated by level portion 52*c* of line 52, for a selected value of exposure voltage of U1, the exposure time t no longer increases as a function of patient thickness for patient thicknesses of $D_2$ and above. The thickness $D_2$ is determined by the point of intersection of voltage line U1 with curve 51 (as indicated at 51-1). For an exposure voltage setting of U1, if the patient thickness exceeds thickness $D_2$, the function generator 26 causes the exposure voltage to increase so that it is equal to the minimum required exposure voltage for the existing patient thickness. Thus, the function generator supplies an output signal via output line 27 which no longer corresponds to selected voltage U1 but instead corresponds to a higher voltage above point 51-1 on curve 51 and corresponding to the patient thickness greater than $D_2$.

For the case of adjustment of the exposure voltage above a selected value of U1 for a patient thickness above a value $D_2$, the pulse width is held at a maximum value as indicated at 52*c*, and the x-ray tube power is held constant at a maximum value $p_{max}$ as indicated at 53*c*. Thus if the exposure voltage is increased above the selected value U1, the x-ray tube current is correspondingly reduced to prevent the x-ray tube power from assuming an inadmissible value.

As further examples, if the exposure voltage has been set at U2, the voltage must be increased for patient thicknesses exceeding that corresponding to point 51-2 on curve 51, and the exposure time is held constant at a value corresponding to that at point 52-2 on curve 52. Similarly for a selected exposure voltage of U3, the limit patient thickness is indicated at 51-3, and the maximum exposure time is indicated at 52-3.

The invention is described in conjunction with a motion picture camera for the recording of images at a selected number of frames per second. On principle, however, it is suited for every type of x-ray exposure recording device. In the exemplary embodiment, it is only necessary, for a movie scene, to select the image frequency and to start an exposure via an exposure release 34. Further adjustments are not required, for the exposure voltage is automatically taken over from the setting of fluoroscopic voltage. The x-ray tube current is also automatically adjusted via the function generator 26. The keys 31, 32 are to be actuated only in that case in which a fixed setting of the exposure voltage is desired.

It will be apparent that many modifications and variations may be effected without departing from the scope of the novel concepts and teachings of the present invention.

As will be understood by those skilled in the art, the display 33 may be operated in conjunction with a decimal counter which may count between a minimum count value of say fifty kilovolts (50 kV) and a maximum count value such as one hundred and twenty-five kilovolts (125 kV) in steps of one kilovolt. The keys 31 and 32 may cause counting up or down respectively so long as they are held depressed. If setting means 31–33 is to be inactive, the counter may be set to a zero count value which may be displayed at 33, and used by logic to restore automatic selection of exposure voltage.

When the operator has selected a key 30 according to the desired image frequency and according to whether the patient is of a light, medium or heavy build, a predetermined amplifier of function generator 26 may be selected for example as taught with reference to the fifth figure of U.S. Pat. No. 3,991,314. If, however, setting means 31–33 has been set to a non-zero value, then the input seventy-eight of said fifth figure may instead receive an analog signal in accordance with the count value registered in the counter of setting means 31–33, in which case tap 15 will be set to a value corresponding to the exposure voltage displayed at 33.

After contact 17 is closed at the beginning of each exposure cycle for a frame of film camera 4, the exposure time control 8 will cause contact 17 to reopen and terminate the x-ray pulse as soon as the integrated signal from photomultiplier 6 reaches a predetermined value. Should the exposure duration be less than $t_{min}$, FIG. 2, the tube current is controlled via connection b to maintain the minimum exposure time. Should patient thickness increase, the exposure time t during which contact 17 is closed increases once tube power reaches the $p_{max}$ value, FIG. 2.

The exposure voltage U may be increased above a selected value such as U1 according to curve 51 by controlling the amplification of an amplifier interposed between the digital to analog converter of setting means 31–33 and the aforesaid input seventy-eight, the amplification being maintained at a sufficiently high value to prevent the exposure time t from exceeding $t_{max}$, FIG. 2.

We claim as our invention:

1. An x-ray diagnostic device for fluoroscopy and exposure, comprising an image intensifier television chain, a dose output control device for dose output regulation during fluoroscopy, circuit means for sensing fluoroscopic voltage, automatic exposure control means comprising a function generator connected with said circuit means and in which the course of the exposure voltage is programmed as a function of the fluoroscopic voltage, said circuit means supplying a signal corresponding to the respective fluoroscopic voltage to said function generator, said function generator having a plurality of programs stored therein, and manual selector means for manually selecting one of the stored programs, characterized in that a setting device (31, 32) for the free setting of the exposure voltage is present; and in that the automatic exposure control means (6, 8, 26) is responsive to a fixed setting of the exposure voltage by the setting device to override said stored programs and to adjust the x-ray tube current given constant exposure time for patient thicknesses that lie below a lower value ($D_1$) and, for patient thicknesses exceeding this lower value, adjusts the exposure time given constant x-ray tube current.

2. An x-ray diagnostic device according to claim 1, characterized in that a motion picture camera (4) is provided for recording exposure images; and in that said automatic exposure control means comprises exposure time control means (8) for setting the pulse width of each pulse of exposure voltage during the recording of successive images by the motion picture camera.

3. An x-ray diagnostic device according to claim 2, characterized in that the automatic exposure control means (6, 8, 26) is responsive to a fixed setting of the exposure voltage by the setting device and to an upper limit of patient thickness which is allocated to the load limit of the x-ray tube (2), to adjust the exposure voltage given constant x-ray tube output and a constant pulse width.

* * * * *